United States Patent [19]

Muhlnickel, Jr.

[11] Patent Number: 4,635,852

[45] Date of Patent: Jan. 13, 1987

[54] HYDRAULIC VALVE FOR SPRAY GUN

[75] Inventor: Donald L. Muhlnickel, Jr., Goshen, Ind.

[73] Assignee: Graves Spray Supply Company, Goshen, Ind.

[21] Appl. No.: 632,292

[22] Filed: Jul. 19, 1984

[51] Int. Cl.[4] ..... B05B 7/14

[52] U.S. Cl. ..... 239/414; 239/416.4; 239/434.5; 239/527; 137/625.4; 137/625.48

[58] Field of Search ..... 239/415, 416, 416.4, 239/417, 526, 427, 427.3, 414, 416.5, 527, 434.5, 416.5; 137/625.4, 625.48; 425/133.1

[56] References Cited

U.S. PATENT DOCUMENTS

| | | | |
|---|---|---|---|
| 500,005 | 6/1893 | Jones | 417/406 |
| 953,511 | 3/1910 | Brooks | 239/414 |
| 1,361,527 | 12/1920 | Johns | 239/414 |
| 1,490,238 | 5/1924 | Sullivan | 239/527 |
| 1,536,352 | 5/1925 | Murray | 239/427.3 |
| 1,956,506 | 4/1934 | Johnson | 158/70 |
| 2,025,028 | 12/1935 | Fausek et al. | 158/27.4 |
| 2,095,751 | 10/1937 | Kirk et al. | 158/27.4 |
| 2,212,052 | 8/1940 | Schultz | 239/427 |
| 3,006,559 | 10/1961 | Schmidt | 239/414 |
| 3,215,352 | 11/1965 | Meraz | 239/414 |
| 3,352,333 | 11/1967 | Glasgow et al. | 239/415 |
| 3,801,009 | 4/1974 | Marshall | 239/414 |
| 3,883,077 | 5/1975 | Showalter | 239/415 |
| 4,117,955 | 10/1978 | Sokolow | 137/625.4 |

*Primary Examiner*—Joseph F. Peters, Jr.
*Assistant Examiner*—Scott D. Malpede
*Attorney, Agent, or Firm*—Barnes & Thornburg

[57] ABSTRACT

A hydraulic valve arrangement is provided for simultaneously opening or closing off the flow of fluid from a plurality of separate and distinct inlet fluid lines to a plurality of concentric fluid passageways connected to an internal mixing chamber having an outlet nozzle leading therefrom. The valve arrangement includes a spool valve axially slidable within a bore of a housing. This spool valve includes at least a central fluid passageway therethrough and another, concentric fluid passageway defined between the spool valve and the bore. When the spool valve is in the open position, the inlet fluid lines are in fluid communication with both the central passageway and the concentric passageway. Fluid flowing through these passageways enters into the interior mixing chamber and exits that chamber through the outlet nozzle. When the spool valve is in the closed position, flow from the inlet fluid lines to the passageways is cut off.

12 Claims, 4 Drawing Figures

HYDRAULIC VALVE FOR SPRAY GUN

BACKGROUND AND SUMMARY OF THE INVENTION

The present invention relates generally to devices having internal mixing of diverse fluid components and, more particularly, to fiberglass spraying apparatus.

Fiberglass spraying apparatus or spray guns are known generally and typically serve to mix fluid streams of a resin and a catalyst and apply the resulting fluid mixture to a workpiece. These resin and catalyst fluid streams may be mixed internally or externally with respect to the spray gun housing. If the catalyst and resin fluid streams are mixed externally, the catalyst is typically atomized by and mixed with compressed air internally prior to the catalyst/resin mix. The compressed air serves as a propellant for the atomized catalyst and proides a more uniform mixture of the catalyst and resin fluids. A further discussion of this method of fiberglass spraying may be found in copending U.S. patent application Ser. No. 548,632, filed Nov. 4, 1983, assigned to the same assignees of the present invention.

FIG. 1 shows an exemplary spray gun 10 of this type having a housing 12 with inlet ports 14 and 16 and outlet nozzle 18. Fluid delivery lines 20 and 22 are connected to inlet ports 14 and 16, respectively. Delivery line 20 typically includes inner hose 24 and outer hose 26 arranged coaxially. Fluid catalyst, compressed air, and fluid resin are supplied to housing 12 through inner hose 24, outer hose 26, and delivery line 22, respectively.

Housing 12 includes separate passageways for each of these fluid streams from inlet ports 14 and 16 to outlet nozzle 18. The pasageways for the fluid catalyst and compressed air includes coaxial line 30 having inner line 34, connected to inner hose 24, and outer line 36, connected to outer hose 26. The passageway for the fluid resin is line 32, connected to fluid delivery line 22. Coaxial line 30 and line 32 are connected downstream to valve arrangements 40 and 41, respectively. These valve arrangements control the flow of fluid to output lines 38 and 39, for the catalyst/air mixxture and the fluid resin, respectively. In hand held spray guns, such valve arrangements are typically actuated by mechanical, pneumatic, or hydraulic linkages to manually operable trigger 28. From output lines 38 and 39, the fluid components flow through output nozzle 18 for external mixing and application to the workpiece.

Valve arrangement 40 typically includes needle valve 42 which enters inner line 34 and sets directly on the end of that line or on a valve seat mounted on the end of line 34 to control catalyst flow. Fluid flow from outer line 36 is not directly valved and applies fluid pressure to piston 46. Needle valve 42 is connected to piston 46, and spring 44 biases needle valve 42 to close off catalyst flow against the fluid pressure applied to piston 46. Needle valve 42 is opened when downstream fluid pressure is reduced and the fluid pressure on piston 46 exceeds the biasing force of spring 44. Downstream fluid pressure reduction is caused by actuation of outlet valve 48 which permits fluid flow to outlet line 38. Outlet valve 48 is actuated when trigger 28 is operated. When needle valve 42 is opened, the end of inner line 34 also serves as a nozzle for catalyst flow into the compressed air. Fluid catalyst and compressed air are thus mixed during flow past the valving elements and into outlet line 38.

While such spray gun arrangements perform satisfactorily in some applications, a number of disadvantages and restrictions have become apparent. The use of coaxial lines for the compressed air and fluid catalyst greatly increases both the initial cost and the maintainance and cleaning costs of the spray gun housing and the fluid delivery lines. Also, great care must be taken during use that coaxial delivery line 20 is not twisted, pulled, or bent since inner hose 24 is much more likely to break, stretch, or kink than outer hose 26 or a non-coaxial hose. Further, special fittings, sleeves, and housings are necessary for the coaxial connections between fluid delivery line 20, inlet port 14, and valve arrangement 40.

The versatility of a given spray gun is also restricted. The spray gun described above does not readily permit, for example, use with only a single fluid component supplied through only hose 24 or use with multiple fluid components where the fluid flow through line 36 needs to be controlled directly (as needle valve 42 directly controls flow through path 34). This latter occasion may arise where precise catalyst-air mixture proportions must be maintained or where fluid catalyst and resin are mixed internally.

Previous spray guns of the type shown in FIG. 1 also often do not provide adequate catalyst atomization and even mixing of the catalyst and air, especially when needle valve 42 is just opened. In part this results because needle valve 42 only restricts flow through one of the paths of passageway 30. The configuration of the fluid passageways through valve arrangement 40 also affects the mixing characteristics of the catalyst and air.

Further problems include excessive component wear and difficulty and expense in replacement and cleaning of these components. In particular, needle valves require matching seats to adequately prevent leaks. These needle valves and seats often wear out unevenly or at different rates and yet, since they must be matched, both components are replaced when only one has worn out. Also since the individual components of valve arrangement 40 are in the fluid flow path and exposed to the catalyst/air mixture, the spray gun must be disassembled and/or the individual components cleaned after each use. Otherwise, elements such as needle valve 42 and piston 46 may stick to the passageway walls rather than slide smoothly, thus causing catalyst to back up into other flow lines and preventing proper catalyst atomization.

A similar problem with prior spray guns is with fluid clogging around valve elements and packing seals. Clogging prevents proper valve actuation and increases leakage. Clogging may be caused by trace amounts of oil or water in the compressed air or by catalyst crystals in the fluid catalyst line. In spray gun 10 of FIG. 1, piston 46 has little sliding clearance within the housing bore and these impurities in the fluid flows could, for example, cause temporary or permanent freezing of the piston to the bore walls. Generally, the more complicated the internal valving mechanisms and the smaller the moving component clearances are, the more likely that clogging will occur.

It is therefore an object of the present invention to provide a simplified, inexpensive valve arrangement for use in spray guns.

Another object is the piston of a spray gun apparatus with a reduced tendency to cause clogging and simplified component assembly.

A further object is to provide a fiberglass spray gun with an improved valve arrangement for controlling internal mixing of diverse fluids.

Yet another object is the provison of a fiberglass spray gun having a valve assembly for controlling and improving catalyst atomization and having reduced wear characteristics and an easily cleaned, simplified actuation mechanism.

These and other objects are attained in the provision of a hydraulic valve arrangement for simultaneously opening or closing off the flow of fluid from a plurality of separate and distinct inlet fluid lines to a corresponding plurality of concentric fluid passageways connected to an internal mixing chamber having an outlet nozzle leading therefrom. The valve arrangement includes a spool valve axially slidable within a bore of a housing. This spool valve includes at least a central fluid passageway therethrough and another, concentric fluid passageway defined between the spool valve and the bore. When the spool valve is in the open position, both inlet fluid lines are in fluid communication with the central passageway and the concentric passageway respectively. Fluid flowing through these passageways enters into the interior mixing chamber and exits that chamber through the outlet nozzle. When the spool valve is in the closed position, flow from the inlet fluid lines to the passageways is cut off.

This type of valve arrangement is especially advantageous for use with apparatus feeding multiple fluid component materials through a single valve since the components are mixed at the end of the valve and yet kept separate until that point. For example, in fiberglass spraying apparatus the present invention is employed to mix fluid catalyst and compressed air. Separate inlet fluid lines supply fluid catalyst and compressed air to the central passageway and concentric passageway, respectively. These fluids are thoroughly mixed and the catalyst atomized within the interior mixing chamber prior to exiting through the outlet nozzle. The atomized catalyst is mixed with the resin downstream from that point.

Further objects, advantages, and novel features of the present invention will become more apparent from the following description when considered in conjunction with the accompanying drawings which show, for purposes of illustration only, embodiments in accordance with the present invention.

DESCRIPTION OF THE DRAWINGS

Figure 1:
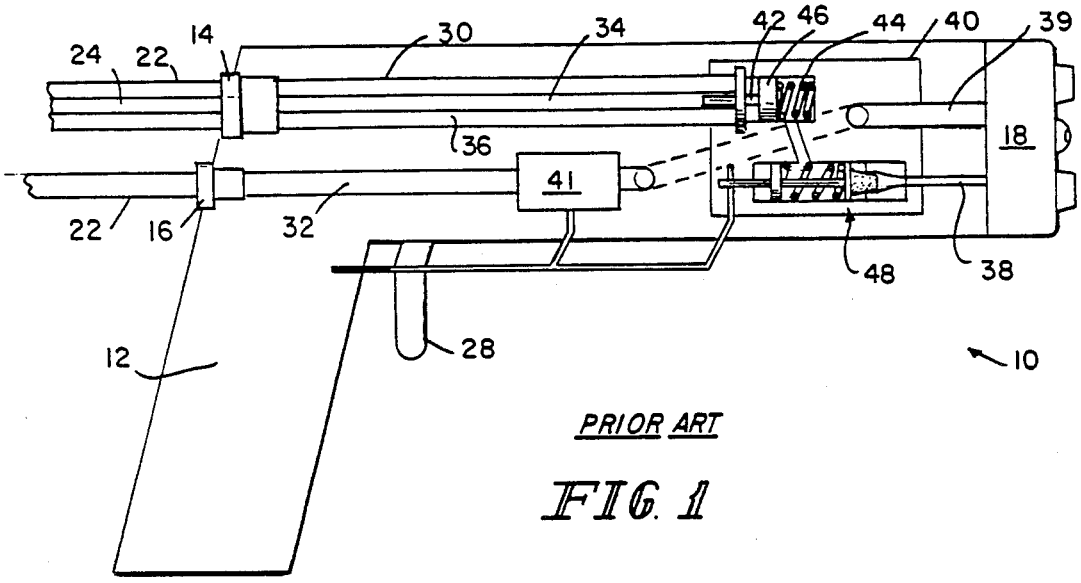
PRIOR ART FIG. 1
FIG. 1 shows a partial cross-sectional view of a spray gun suitable for use in fiberglass spraying, according to prior teachings.
Figure 2:
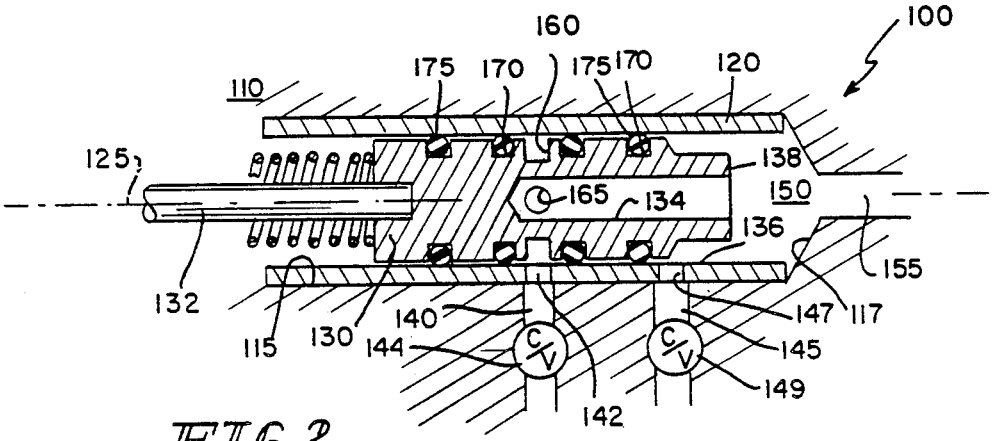
FIG. 2 shows a cross-sectional view of a valving arrangement for use in spray guns, according to the teachings of the present invention, in the open position.
Figure 3:
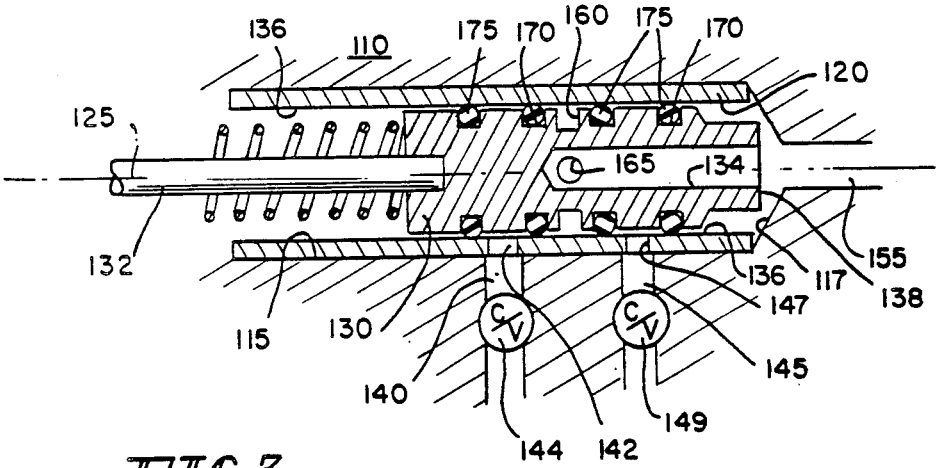
FIG. 3 shows a cross-sectional view of the valving arrangement of FIG. 2 in the closed position.

FIG. 2, which illustrates a preferred embodiment of the present invention, shows, cross-sectionally, valve arrangement 100 which may be mounted within a spray gun of the type shown in FIG. 1 in place of the valve 40 with the below described modifications. FIG. 2 shows valve arrangement 100 in the open position; FIG. 3 shows a similar view of valve arrangement 100 in the closed position.

Valve arrangement 100 includes housing 110 having longitudinally extending bore 115 therein with sleeve 120 lining the interior walls thereof. Spool valve 130 is mounted within sleeve 120 such that it is slidable with respect to longitudinal axis 125 of bore 115.

Inlet fluid lines 140 and 145 are connected to inlet ports 142 and 147, respectively, of bore 115. Spool valve 130 includes central passageway 134. Concentric fluid passageway 136 is defined between the exterior wall of spool valve 130 and sleeve 120 on the interior wall of bore 115. Passageways 134 and 136 extend from inlet ports 142 and 147, respectively, to interior mixing chamber 150, defined between end wall 138 of spool valve 130 and end wall 117 of bore 115. Housing 110 further includes fluid outlet nozzle 155 leading from mixing chamber 150.

In an adaptation of the present invention to the fiberglass spraying environment, liquid catalyst is supplied along inlet fluid line 140 and compressed air along inlet fluid line 145. Spool valve 130 controls the flow of these fluids into passageways 134 and 136, respectively, and thus into mixing chamber 150. Mixing of liquid catalyst and compressed air causes atomization of the catalyst, which then exits through nozzle 155 to mix with the resin at a different location (not shown).

With respect to spray gun 10 of FIG. 1, fluid catalyst and compressed air of the valve assembly of FIGS. 2 and 3 are provided through separate and distinct inlet fluid lines, rather than a single, coaxial line. Further, these fluid compnents are mixed together at a location remote from the valving of the inlet ports after flowing through passageways which are concentrically disposed with respect to each other. The catalyst/air mixture exiting through outlet nozzle 155 may, for example, continue to a spraying outlet nozzle 18 further downstream through an outlet line 38.

In the embodiment shown in FIGS. 2 and 3, spool valve 130 is connected to and actuated by stem 132, which is connected by conventional linkages (not shown) to the spray gun trigger. Depending upon the particular application of the present invention, spool valve 130 may be actuated pneumatically or mechanically by direct linkages or by spring loading.

Inlet fluid lines 140 and 145 enter passageways 134 and 136 laterally with respect to the direction of fluid flow in these passageways and may each include check valve means 144 and 149 upstream from inlet ports 142 and 147. These check valves function as failsafe devices to prevent fluid backflow along the inlet fluid lines, particularly with respect to fluid of a diverse medium which could in some circumstances flow out the inlet ports. This could arise where, for example, the spray gun according to the present invention is employed with only a single fluid component passing therethrough.

The dimensions of inlet ports 142 and 147 are selected to provide the desired flow volume to mixing chamber 150 and backpressure in lines 140 and 145 for a given embodiment and particular usage of the present invention. Spool valve 130 has fluid path groove 160 about its circumference and aligned with inlet port 142, when spool valve 130 is in the open position to receive liquid catalyst from line 140. A plurality of bores 165 provide fluid connection between groove 160 and central passageway 135.

Spool valve 130 also has a plurality of packing grooves 170 about its circumference. Each packing groove has an O-ring seal therein to provide fluid tight sealing between spool valve 130 and sleeve 120. These seals are spaced longitudinally along spool valve 130 to isolate the fluid catalyst and air from each other and the outside environment at all times except along passageways 134 and 136 and in mixing chamber 150. As shown in FIG. 2, when spool valve 130 is in the open position, O-ring seals are on opposite sides of groove 160 and inlet port 142, thus confining the flow of liquid catalyst through inlet port 142 to groove 160, bores 165, and passageway 134. When, as shown in FIG. 3, spool valve 130 is in the closed position, O-ring seals are on opposite side of both inlet ports 142 and 147, thus confining the fluids between the exterior wall of spool valve 130, the respective inlet port, and the O-ring seals on either side so that there is no intermixing of these fluids. Although the Figures illustrate packing grooves 170 and O-ring seals 175 as disposed on spool valve 130, the present invention specifically contemplates embodiments wherein the packing grooves and O-ring seals are disposed on the interior wall of sleeve 120 and/or bore 115. In such alternative arrangements these seals would be placed on either side of each inlet port and the spool valve would slide relative to them. Another alternative contemplated by the present invention would employ radial spring-loaded seals or cup seals rather than O-ring seals.

Figure 4:
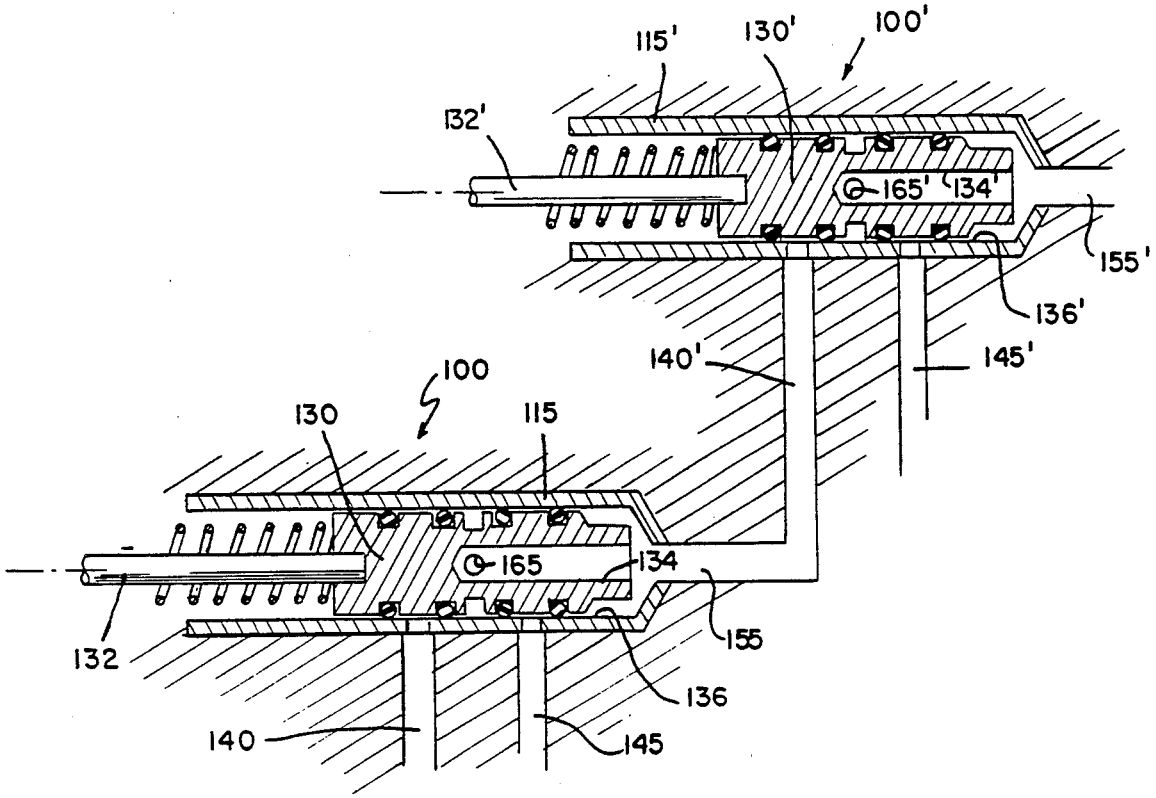
FIG. 4 shows a cross-sectional view of a plurality of valve arrangements of the type shown in FIG. 3 in series.

The present invention is illustrated as providing for internal mixing of two diverse fluids, catalyst and air for example, and this mixture may then flow out to mix either internally or externally, with respect to the housing, with another fluid or to be applied directly to the work. Thus, in fiberglass spray guns the present invention can serve to atomize catalyst for external mixing with fluid resin or to internally mix catalyst and resin directly. Where it is desired to mix more than two fluid streams, internally, a plurality of valving arrangements 100 may be connected in series in a single spray gun housing with fluid from output nozzle 155 flowing into one of the next inlet fluid lines (as shown in FIG. 4 with the elements of the second valving arrangement denoted by primed numbers) or spool valve 130 may be extended longitudinally and a third inlet fluid line connected to a third inlet port and a second central passageway between inlet ports 142 and 147. This latter embodiment of the present invention permits simultaneous mixing of all fluids by actuation of only a single valve.

In the preferred embodiment illustrated and described above central passageway 134 is coaxial with concentric passageway 136 and outlet nozzle 155. It will now be readily understood by those skilled in the art, that the valve assembly of the present invention may have these elements aligned in a variety of different arrangements. Where it is desirable to achieve instant catalyst atomization or otherwise ensure that the separate fluid components arrive simultaneously at mixing chamber 150, it is possible to compensate for the different fluid flow path lengths by pressurizing the fluid components differently. This may be accomplished, for example, by applying pressure through inlet fluid lines 140 and 145 or by adjusting the orifice dimensions of inlet ports 142 and 147.

The present invention provides a number of important advantages over prior spray guns such as that shown in FIG. 1. Unlike prior spray guns, the present invention does not require strong compressive stresses and or packing down between the valve and valve seat elements, thus greatly reducing wear. In fact, since the catalyst and air fluid themselves can function as O-ring seal lubricants, component wear is minimal. Further, since clearances are less critical with the spool valve and O-ring seals, less clogging has been found. Spray gun assembly and maintainance are greatly simplified because of the less complicated valve arrangement of the present invention. Also, the spray guns of the present invention have much greater versatility since any number of the fluid paths of a given valve can be used in a given environment. Thus, in the embodiment of FIG. 2 and 3, if it is desired, valve arrangement 100 may also be employed to control flow through the spray gun of a single fluid having no internal mixing with a diverse fluid. Therefore, the same spray gun may be employed in a variety of different applications.

A particularly important advantage of the present invention with respect to fiberglass spraying where the catalyst is internally atomized is that it eliminates the necessity for coaxial fluid delivery lines and the concerns for the breakdown of the inner hose. Further, it has been found that the present invention provides better flow of the atomized catalyst at lower pressures and more efficient and complete catalyst atomization.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed is:

1. A fiberglass spraying apparatus for internally mixing fluid components of fluid fiberglass comprising:

first housing means having a plurality of inlet ports for separately receiving said fluid components and at least one outlet port through which said fluid components exit after mixing;

first valve means, disposed within said housing means, for defining separate concentric fluid passageways for each of said fluid components and simultaneously opening or closing the fluid connection from said plurality of inlet ports into each of their respective concentric fluid passageways; and first mixing chamber means, connected between said concentric fluid passageways and said outlet port, and remote from said inlet ports, for receiving concentric fluid flows of said fluid components and mixing the same.

2. The apparatus according to claim 1 wherein said apparatus further includes second housing means having a plurality of inlet ports and at least one outlet port, and second valve means, second mixing chamber means, and wherein said at least one outlet port of said first housing means is in fluid communication with at least one of the plurality of inlet ports of said second housing means such that both of said first and second valve means and said first and second mixing chamber means are connected in series to provide sequential mixing of fluid components.

3. The apparatus according to claim 1 wherein said housing includes a bore extending along a longitudinal axis and said valve means includes a spool element slidably disposed within said bore between positions which open and close said fluid connection between said inlet ports and said concentric fluid passageways.

4. A fiberglass spraying apparatus for applying fluid fiberglass to a workpiece comprising:

a housing having a plurality of inlet ports for separately receiving fluid components of said fluid fiberglass through separate and distinct fluid delivery lines and at least one outlet port through which said fluid components exit;

valve means, disposed within said housing means, for defining concentric fluid passageways and simultaneously opening or closing the fluid connection from said plurality of inlet ports to each of said concentric fluid passageways; and internal mixing chamber means, connected between said concentric fluid passageways and said outlet port, for receiving and mixing fluid from at least two of said concentric fluid passageways.

5. The fiberglass spraying apparatus according to claim 4 wherein said fluid components include fluid catalyst and fluid resin and both of these components are mixed together within said internal mixing chamber means.

6. The fiberglass spraying apparatus according to claim 4 wherein said fluid components include resin, catalyst and compressed air and the latter two of these components are mixed together within said internal mixing chamber means such that said catalyst is atomized.

7. The fiberglass spraying apparatus according to claim 6 wherein said atomized catalyst and compressed air mixture are applied to and mixed with said resin exteriorly of said housing.

8. The fiberglass spraying apparatus according to claim 4 wherein said valve means is directly actuated to open and close said fluid connection between said inlet ports and said concentric fluid passageways by a trigger mechanism mounted on said housing.

9. The fiberglass spraying apparatus according to claim 4 wherein said housing includes a longitudinally extending bore and said valve means includes a spool valve slidably disposed in said bore, said spool valve having an interior passageway defining at least one of said concentric fluid passageways and another of said concentric fluid passageways being defined between the exterior surface of said spool valve and the interior surface of said bore.

10. The fiberglass spraying apparatus according to claim 9 wherein said bore has a longitudinal axis and said concentric fluid passageways are coaxial with respect to this axis.

11. The fiberglass spraying apparatus according to claim 9 wherein said spool valve includes sealing means which prevents fluid flow between said inlet ports except through said concentric fluid pasageways.

12. The fiberglass spraying apparatus according to claim 4 wherein said fluid components are pressurized to compensate for differences in the flow path lengths from said inlet ports to said internal mixing chamber means such that, upon actuation of said valve means, fluid components to be received by said internal mixing chamber means are received simultaneously.

* * * * *